US007789578B2

(12) United States Patent
Sapir-Haim

(10) Patent No.: US 7,789,578 B2
(45) Date of Patent: Sep. 7, 2010

(54) SYSTEM FOR BOOK PRINTING AND ASSEMBLY USING A PRE-BOUND PAGE BLOCK

(75) Inventor: Roni Reuven Sapir-Haim, Kfar Saba (IL)

(73) Assignee: Revoprint Ltd., Tel Aviv (IL)

( * ) Notice: Subject to any disclaimer, the term of this patent is extended or adjusted under 35 U.S.C. 154(b) by 0 days.

(21) Appl. No.: 12/349,237

(22) Filed: Jan. 6, 2009

(65) Prior Publication Data

US 2009/0173243 A1 Jul. 9, 2009

Related U.S. Application Data

(62) Division of application No. 11/131,289, filed on May 18, 2005, now Pat. No. 7,547,152.

(51) Int. Cl.
*B41J 3/28* (2006.01)

(52) U.S. Cl. ..... 400/28; 400/24

(58) Field of Classification Search ..... 400/24, 400/28; 412/2; 270/1.02
See application file for complete search history.

(56) References Cited

U.S. PATENT DOCUMENTS 2,170,049 A * 8/1939 Faeber ..... 412/29
4,029,193 A 6/1977 Kwan
4,480,517 A * 11/1984 Miyamoto ..... 83/210
4,503,960 A 3/1985 Koeleman et al.
4,527,814 A * 7/1985 Carter et al. ..... 281/31
4,776,711 A 10/1988 Harada
4,928,995 A 5/1990 Pickering et al.
5,156,465 A 10/1992 Kakiuchi (Continued)

FOREIGN PATENT DOCUMENTS

DE 19537742 4/1997

(Continued)

OTHER PUBLICATIONS

International Search Report for International Application No. PCT/IL06/00582 mailed Jun 30, 2008.

(Continued)

*Primary Examiner*—Daniel J Colilla
(74) *Attorney, Agent, or Firm*—Pearl Cohen Zedek Latzer, LLP

(57) ABSTRACT

A printing apparatus configured to print on the pages of a block of printable pages that are pre-bound by a binding along a binding-edge of each page. The pages of the block are arranged in two interconnected stacks that are joined by the flexible binding. Printing is performed on the top surfaces of each of the stacks, and then a top page is redeployed from one stack to the other. During the redeployment process, the page is turned, thereby revealing an unprinted side of the page. Since the height of each of the stacks changes each time a page is redeployed, the printing apparatus includes two height-adjustable stack support tables each associated with a corresponding one of the two stacks. The support tables are configured to adjust their height so as to maintain the planar relationship of the top surfaces of each of the stacks. After printing, the printed pages are removed separated from the unprinted pages. A book-cover is then attached to the printed pages to complete the book.

6 Claims, 9 Drawing Sheets

U.S. PATENT DOCUMENTS

| | | | | |
|---|---|---|---|---|
| 5,191,379 | A | 3/1993 | Manzer et al. | |
| 5,267,799 | A | 12/1993 | Nukada | |
| 5,471,277 | A * | 11/1995 | Fujioka et al. | 355/25 |
| 5,806,991 | A | 9/1998 | Hubler | |
| 6,036,381 | A * | 3/2000 | Mizukami et al. | 400/25 |
| 6,762,356 | B2 | 7/2004 | McNab et al. | |
| 7,006,263 | B2 * | 2/2006 | Takahashi | 358/474 |
| 2001/0022911 | A1 * | 9/2001 | Kimura et al. | 400/24 |
| 2002/0054372 | A1 | 5/2002 | Takahashi | |

FOREIGN PATENT DOCUMENTS

| | | | |
|---|---|---|---|
| EP | 0381137 | | 8/1990 |
| EP | 0503476 | | 9/1992 |
| JP | 2200496 | | 8/1990 |
| JP | 03182925 | A * | 8/1991 |
| JP | 4226398 | | 8/1992 |
| JP | 05162485 | A * | 6/1993 |
| JP | 6171268 | | 6/1994 |
| JP | 8142542 | | 6/1996 |
| JP | 2004082515 | | 3/2004 |
| SI | 9800056 | | 10/1999 |
| WO | WO 2006/123338 | A2 | 11/2006 |

OTHER PUBLICATIONS

International Preliminary Search Report for International Application No. PCT/IL06/00582 mailed Aug. 6, 2009.

* cited by examiner

SYSTEM FOR BOOK PRINTING AND ASSEMBLY USING A PRE-BOUND PAGE BLOCK

CROSS-REFERENCE TO RELATED APPLICATIONS

This application is a divisional application of U.S. patent application Ser. No. 11/131,289, entitled "System for Book Printing and Assembly Using a Pre-Bound Page Block", filed on May 18, 2005, now U.S. Pat. No. 7,547,152 which is incorporated in its entirety herein by reference.

FIELD AND BACKGROUND OF THE INVENTION

The present invention relates to book printing and assembly and, in particular, it concerns printing on pre-bound pages and attaching a pre-fabricated book-cover.

The state of the art of book printing and assembly, while having seen much in improved mechanization that is addressed to the speed and quality of the printing and binding processes, has seen little change in the basic steps of book printing and assembly.

Generally speaking, the process is as follows. First, the pages are printed. Next, the pages are cut in order to be collated or assembled into signatures. Then, the text block is formed by connecting the signatures, either by sewing or gluing. Finally, the cover is attached. Therefore, the process of forming the text block is performed only on the number of pages in the book and the process is repeated for each book being produced.

This process is well suited for mass production, but leaves little room for affordable production of a small number of books, and is totally unsuited for production of a single book.

U.S. Pat. No. 4,776,711 discloses a printing apparatus for printing on the pages of a pre-bound bank passbook. This apparatus employs two printing devices, one associated with each of the exposed pages. The two printing devices are used to compensate for the different heights of each of the pages.

There is therefore a need for a system for producing a book by printing directly on the pages of a pre-bound page block, separating the printed pages from the page block and attaching a cover to the resultant text block. It would be beneficial if the system employed a single printing device.

SUMMARY OF THE INVENTION

The present invention is a system for producing a book by printing directly on the pages of a pre-bound page block, separating the printed pages from the page block and attaching a cover to the resultant text block.

According to the teachings of the present invention there is provided, a method for producing printed material, the method comprising: a) providing a block configured from a plurality of blank pages that are pre-bound by a binding along a binding-edge of each page; b) arranging the block so as to form two adjacent stacks interconnected by the binding, such that at least one of a plurality of the printable pages is deployed in a first stack and a remainder of the plurality of the printable pages are deployed in a second stack, and printable top surfaces of the first stack and the second stack are co-planar; c) generating relative movement between a printing device and the printable top surfaces so as to print on the top surface of at least one of the first stack and the second stack; d) redeploying a top page of the second stack to the first stack so as to produce new the printable top surfaces; and e) repeating steps (c) and (d) as required to print a number of pages required.

According to a further teaching of the present invention, there is also provided, separating printed pages of the printed material from the block.

According to a further teaching of the present invention, the separating printed pages is accomplished using a cutting element associated with the printing device, the cutting element configured to separate the first stack from the second stack.

According to a further teaching of the present invention, there is also provided, attaching the printed pages of the printed material to a book-cover that includes an attachment configuration for interconnection with the printed pages of the printed material.

According to a further teaching of the present invention, the book-cover is implemented as a pre-fabricated adjustable book-cover with an adhesive spine area shielded by at least one peal-off cover-sections configured to reveal a predetermined adhesive area when removed, such that an area of the adhesive spine corresponding to a size of a binding area of the printed pages of the printed material is revealed for the attaching.

According to a further teaching of the present invention, there is also provided, providing two block support tables each associated with a corresponding one of the first stack and the second stack, a relative height of the block support tables being adjustable so as to maintain the co-planar printable top surfaces of the first stack and the second stack.

According to a further teaching of the present invention, there is also provided, adjusting a height of each of the first stack and the second stack subsequent to each the redeploying the top page of the second stack to the first stack so as to deploy the new the printable top surfaces at a predetermined printing height.

According to a further teaching of the present invention, there is also provided, determining the number of pages redeployed during the redeploying the top page of the second stack to the first stack using a sensor configured determine the thickness of material redeployed.

There is also provided according to the teachings of the present invention, an apparatus for printing on the pages of a block of printable pages that are pre-bound by a binding along a binding-edge of each page, the apparatus comprising: a) an apparatus frame; b) a block support structure configured to allow deployment of the block in the frame so as to form two adjacent stacks interconnected by the binding, such that at least one of a plurality of the printable pages is deployed in a first stack and a remainder of the plurality of the printable pages are deployed in a second stack, and printable top surfaces of the first stack and the second stack are co-planar; c) a printing device associated with the frame; d) a displacement mechanism configured to generate relative movement between the printing device and the printable top surfaces so as to print on the top surface of at least one of the first stack and the second stack; and e) a page turning mechanism associated with the frame, the page turning mechanism configured for redeploying a bound top page of the second stack to the first stack so as to produce a new the printable top surface.

According to a further teaching of the present invention, the binding is a flexible adhesive binding.

According to a further teaching of the present invention, the block support structure includes with two block support tables each associated with a corresponding one of the first stack and the second stack, the two block support tables configured such that a relative height of the block support tables is adjustable so as to maintain the co-planar printable top surfaces of the first stack and the second stack.

According to a further teaching of the present invention, there is also provided, at least one top surface positioning element configured to control a height of the printable top surface during printing.

According to a further teaching of the present invention, the displacement mechanism is configured to move the printing device about an X and Y axes of the printable top surface.

According to a further teaching of the present invention, the page turning mechanism is associated with the displacement mechanism such that return of the printing device to a home position affects the redeploying the top page of the second stack to the first stack.

According to a further teaching of the present invention, the page turning mechanism includes at least one page turning arm displaceable between a page printing position and a page turning position.

According to a further teaching of the present invention, there is also provided, a page lifting mechanism configured to lift the top page of the second stack for engagement with the page turning arm and redeployment to the first stack.

According to a further teaching of the present invention, the page lifting mechanism includes an electrostatic element.

According to a further teaching of the present invention, there is also provided, a sensor configured to determine is a single page was turned by the page turning mechanism.

According to a further teaching of the present invention, there is also provided, a cutting element configured to separate the first stack from the second stack.

There is also provided according to the teachings of the present invention, a kit for preparation of bound printed material, the kit comprising; a) a block of printable pages that are pre-bound by a binding; b) an apparatus for printing on pages of the block of printable pages; and c) a book-cover that includes an attachment configuration for interconnection with pre-bound printed pages of the printed material.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a system for producing a book by printing directly on the pages of a pre-bound page block, separating the printed pages from the page block and attaching a cover to the resultant text block.

The principles and operation of a system for producing a book according to the present invention may be better understood with reference to the drawings and the accompanying description.

By way of introduction, the present invention includes a printing apparatus, a method for producing a book using such an apparatus, and a kit for the preparation of pre-bound printed material, which includes the printing apparatus, block of pre-bound printable pages and bookcover. The printing apparatus is configured to print on the pages of a block of printable pages that are pre-bound by a binding along a binding-edge of each page. Since the pages are bound together before printing, it is necessary to arrange the block in two interconnected stacks that are joined by the flexible binding. Printing is performed on the top surfaces of each of the stacks, and then a page is redeployed from one stack to the other. During the redeployment process, the page is turned, thereby revealing an un-printed side of the page. Since the height of each of the stacks changes each time a page is redeployed, the printing apparatus includes two height-adjustable stack support tables each associated with a corresponding one of the two stacks.

As used herein, the phrase "printable pages" refers to pages that may be printed using the printing apparatus of the present invention. It is within the scope of the present invention that such pages may be pre-printed with, but not limited to, watermarks, background designs, illustration, and pictures. The term "pre-bound" as used herein refers to the interconnection of a number of individual pages along one edge of each page by any binding method known in the art. The use of the phrase "bound printed material" herein refers to substantially any print medium in which pages are bound together such as, but not limited to, books, booklets, notebooks, pamphlets, brochures, and catalogs.

Figure 1:
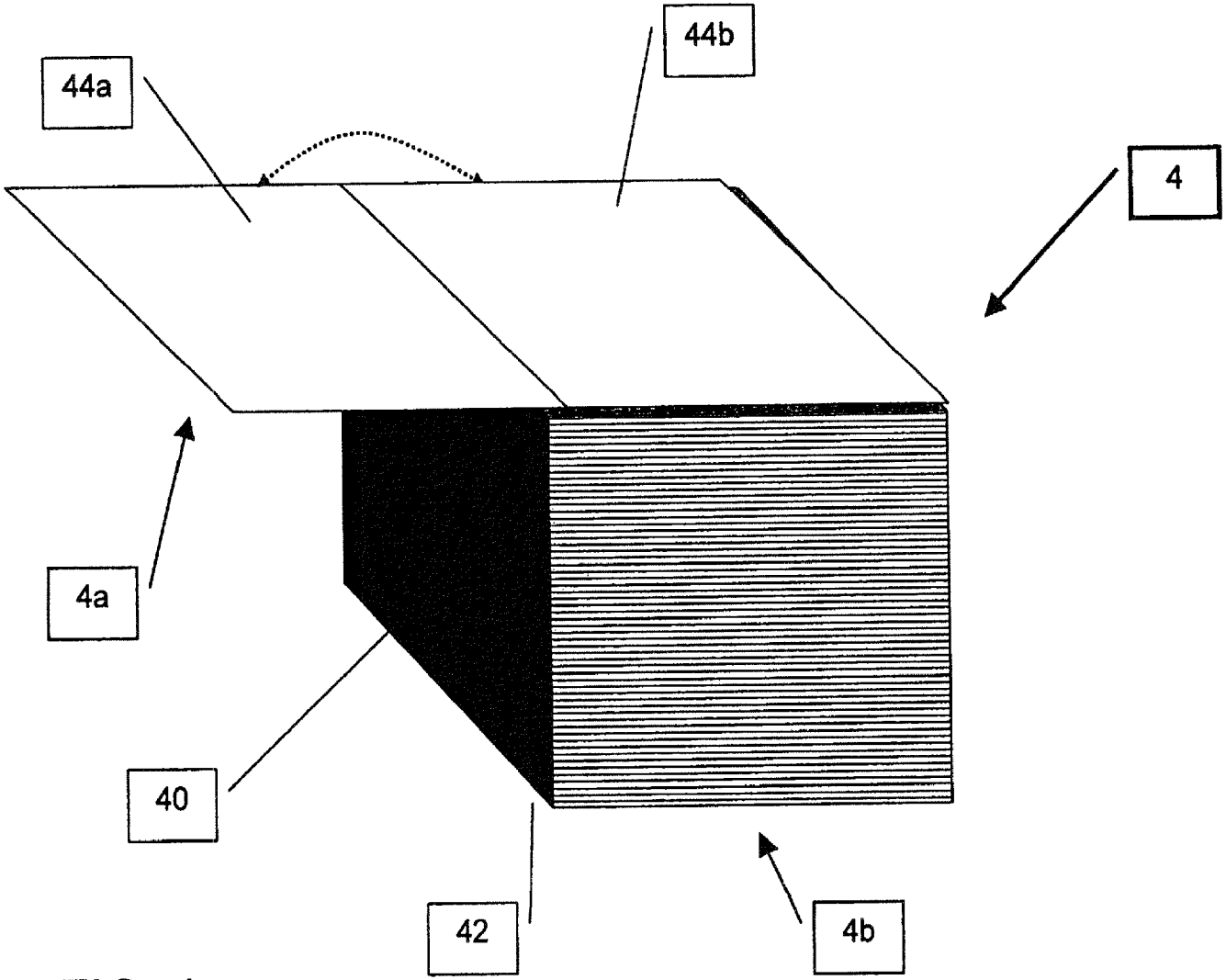
FIG. 1 is an isometric view of a block of printable pages that are pre-bound by a binding along a binding-edge of each page, constructed and operative according to the teachings of the present invention.

Referring now to the drawings, FIG. 1 illustrates the block 4 of printable pages that is pre-bound by a flexible binding 40 along a binding-edge 42 of each page. During the printing process, the block 4 is arranged in two stacks 4*a* and 4*b* that are joined by the flexible binding 40. Printing is performed on the printable top surfaces 44*a* and 44*b* of the two stacks 4*a* and 4*b*.

Figure 2:
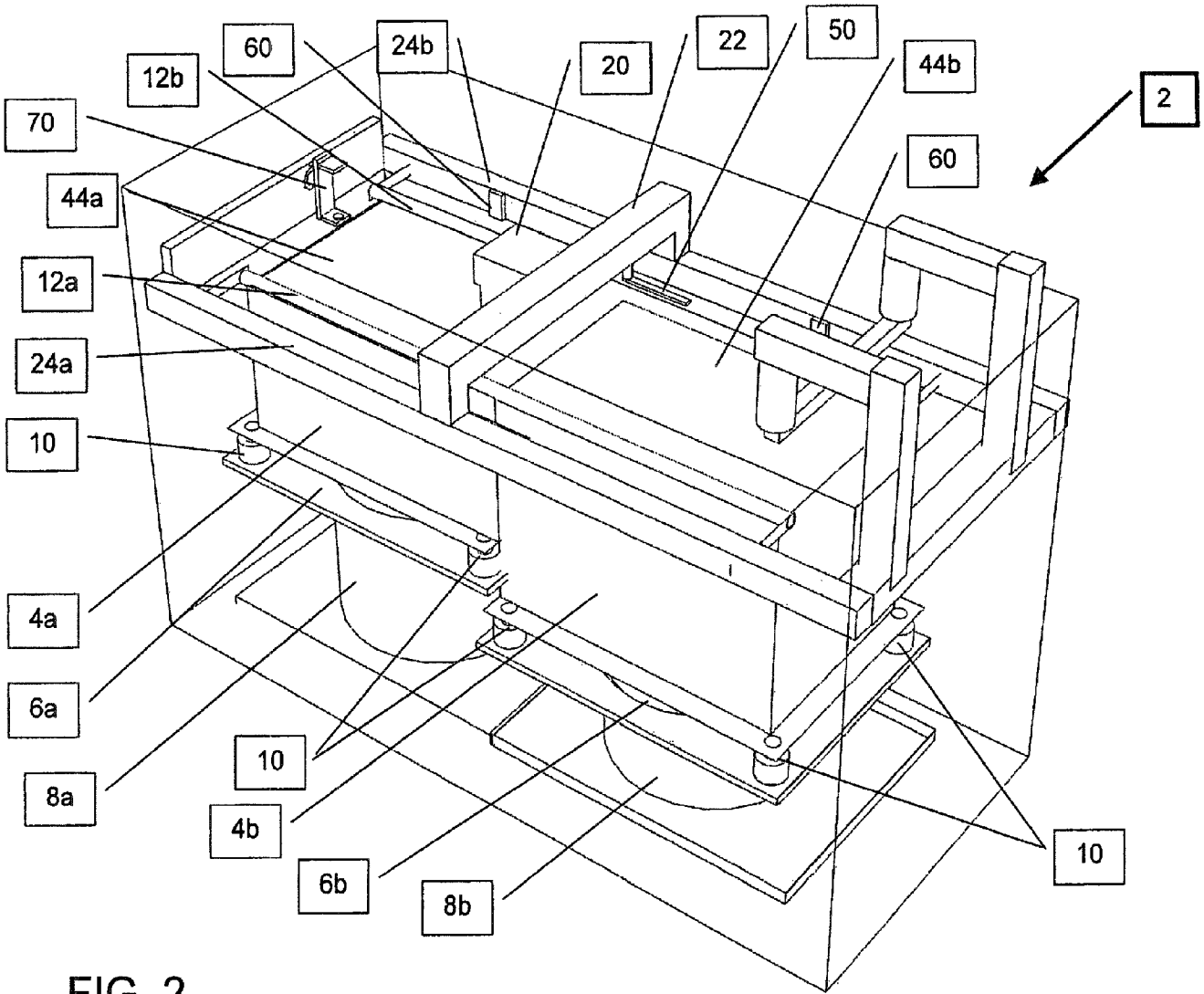
FIG. 2 is an isometric view of a preferred embodiment of a printing apparatus constructed and operative according to the teachings of the present invention.

FIG. 2 illustrates a preferred embodiment of the printing apparatus of the present invention, generally referred to herein as 2. The two stacks 4*a* and 4*b* are arranged on the height-adjustable stack support tables 6*a* and 6*b*, respectively. The height of the height-adjustable stack support tables 6*a* and 6*b* is varied by height-adjustable elements 8*a* and 8*b*. Movement of the height-adjustable elements 8*a* and 8*b* may be actuated by, but not limited to, electric motors, pneumatic devices, hydraulic devices, or substantially any other suitable device know in the art. Preferably, the height-adjustable stack support tables 6*a* and 6*b* are configured with shock absorbing springs 10 to cushion the effects of the height adjustment process, and allow for the final height adjustments of each of the two stacks 4*a* and 4*b* as they are pressed against the paper limit guides 12*a* and 12*b*, as described below. It should be noted that while the springs 10 may represent what may be considered the best mode contemplated for carrying out the invention, other configurations such as, but not limited to, cushioned tables and flexible tables are also within the scope of the present invention.

Figure 3:
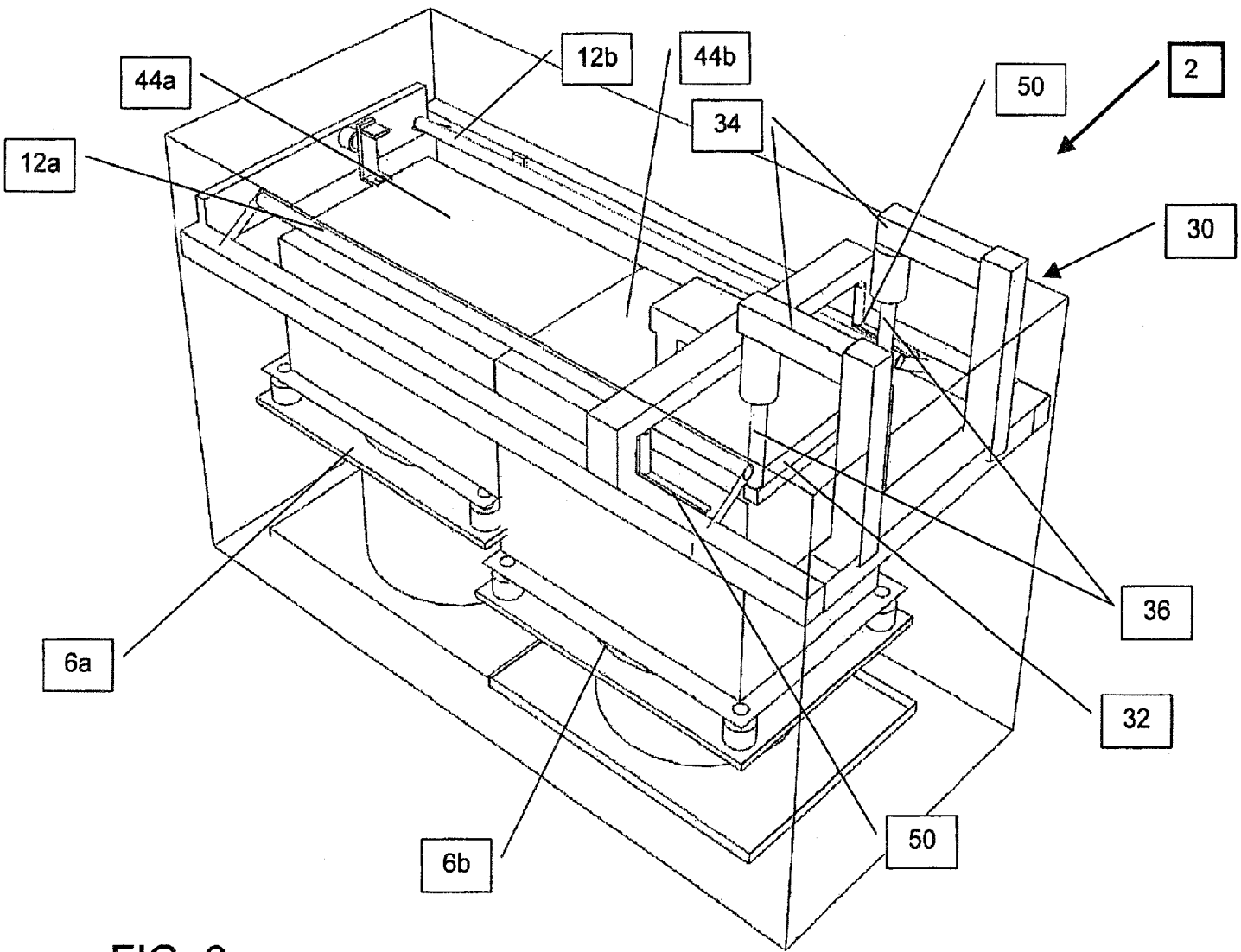
FIGS. 3-5 are a series of isometric views of the embodiment of FIG. 2, showing the turning process according to the teachings of the present invention.
Figure 4:
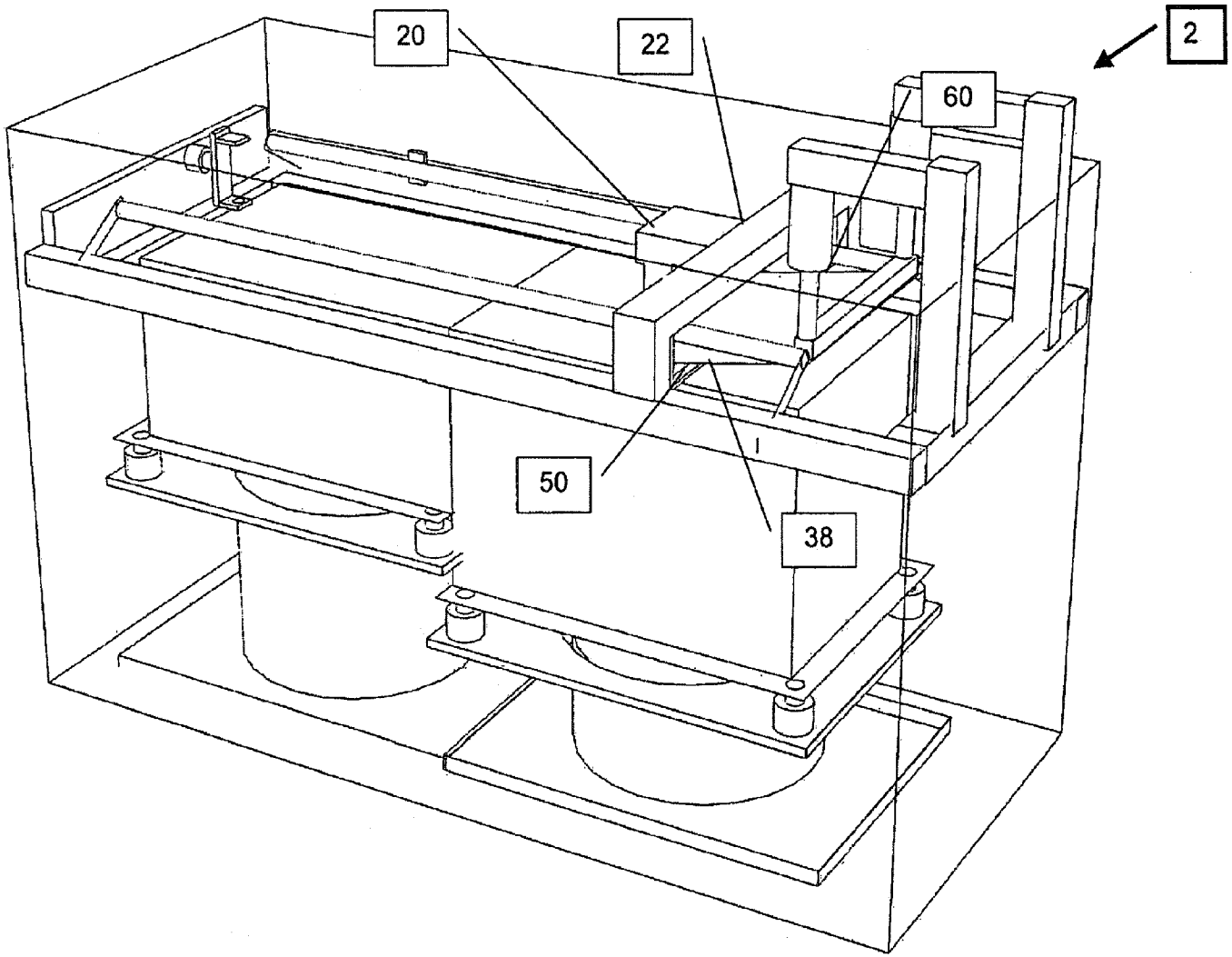
Figure 5:
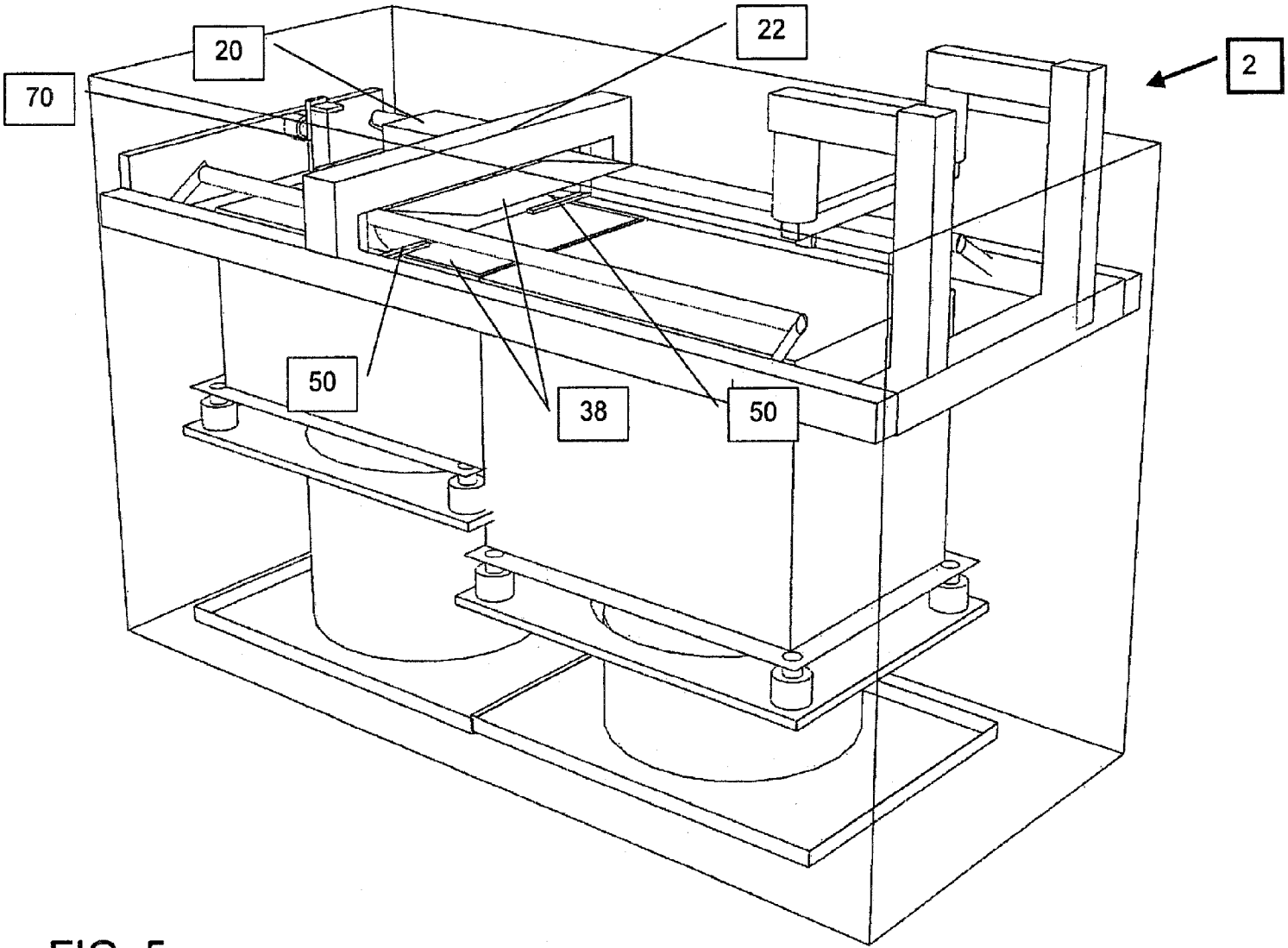

In order to provide a substantially planar printing surface consisting of the printable top surfaces 44*a* and 44*b* of the two stacks 4*a* and 4*b*, the printing apparatus 2 includes substantially parallel paper limit guides 12*a* and 12*b*, which are displaceable between a printing position (FIG. 2) and a paper deployment position (FIGS. 3-5). During the printing process, the paper limit guides 12*a* and 12*b* are deployed in the printing position, such that the printable top surfaces 44*a* and 44*b* are pressed against the paper limit guides 12*a* and 12*b* by the height-adjustable elements 8*a* and 8*b*. The paper limit guides 12*a* and 12*b* are deployed in the paper deployment position when block 4 is initially deployed in the printing apparatus 2, during redeployment of the top page of stack 44*b* to stack 44*a*, and when all or part of block 4 is removed from the printing apparatus 2. It should be noted that the use of stationary paper limit guides may also be employed and is considered to be within the scope of the present invention.

The printing device 20 is preferably driven so as to traverse the Y-axis rail 22, as Y-axis rail 22 is driven along the parallel X-axis rails 24*a* and 24*b*.

As illustrated in FIGS. 3-5, once printing is completed on the printable top surfaces 44*a* and 44*b*, the height-adjustable stack support tables 6*a* and 6*b* are lowered and the paper limit guides 12*a* and 12*b* are raised to the paper deployment position.

FIG. 3 further illustrates the page lifting mechanism 30. Preferably, the page lifting mechanism 30 includes an electrostatic element 32, which is supported by beams 34, and raised and lowered by arms 36. The electrostatic element 32 is therefore lowered to top surface 44*b* and then raised, bringing with it the top page 38 (best seen in FIGS. 4 and 5) of stack 4*b*. Once the top page 38 of stack 4*b* is raised, page-turning arms 50 are rotated from a printing position (FIGS. 2 and 3) to a page turning position (FIGS. 4 and 5). As the Y-axis rail returns the printing device 20 to a home position, the page-turning arm redeploys top page 38 to the top of stack 4*a*, as illustrated in FIG. 5. It will be understood that any device and method used to redeploy and turn the top page of one stack to the other is within the scope of the present invention. It should be noted the scope of the present invention includes employment of a lifting element configured of, but not limited to, an electrostatic element, a vacuum element, and any other element attachable to a page, known in the art.

Figure 6:
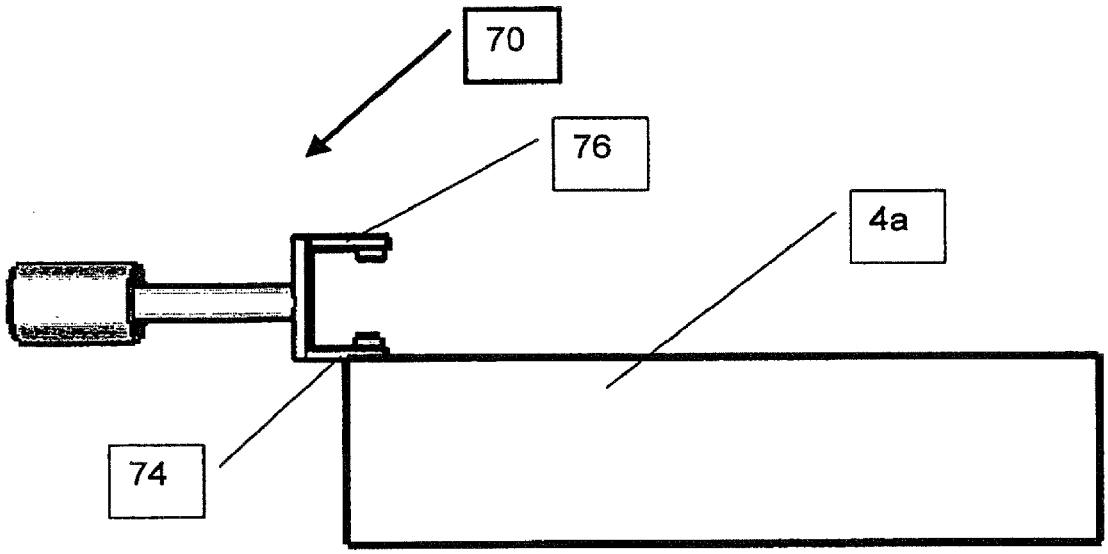
FIGS. 6 and 7 are side elevations illustrating the process of verifying the number of pages turned, according to the teachings of the present invention.
Figure 7:
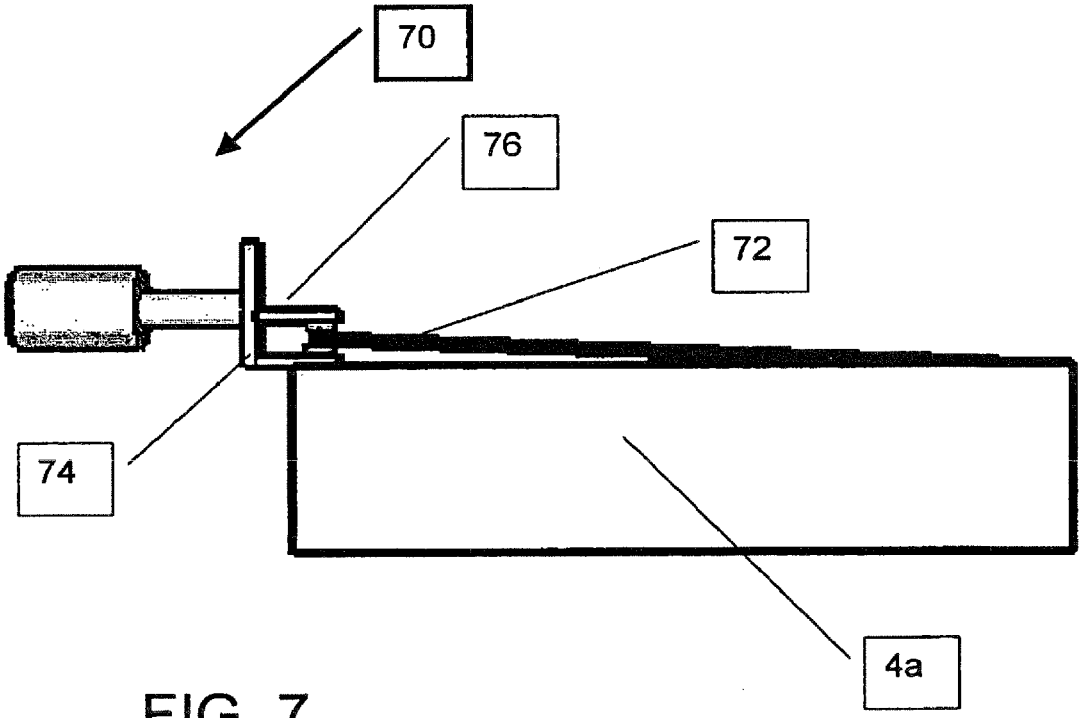

Preferably, the page turning process includes verifying that only one page has been redeployed. This may be accomplished with the use of any of a number of sensing devices known in the art, or by determining the change in the height of each of the stacks 4*a* and 4*b*. Preferably, however, the thickness of the material redeployed to the top of stack 4*a* is measured by gauge 70, which is best illustrated in FIGS. 6 and 7. As illustrated, gauge 70 is extended such that the extreme edge of the material redeployed 72 falls onto the bottom arm 74, the top arm 76 is then lowered to the top surface of the material redeployed 72, and the thickness in determined. If the thickness falls within a range corresponding to the thickness of one of the pages in the block 4, the printing process continues. Conversely, if the thickness falls outside of the range corresponding to the thickness of one of the pages in the block 4, the printing process is halted. Upon conclusion of the measurement process, the gauge 70 is retracted.

After redeploying top page 38 to the top of stack 4*a*, the paper limit guides 12*a* and 12*b* are lowered to the printing position and the height-adjustable stack support tables 6*a* and 6*b* are raised so as to press the printable top surfaces 44*a* and 44*b* against the paper limit guides 12*a* and 12*b*, thereby providing the substantially planar printing surface required for the printing process. In some embodiments, optic sensors 60 may be employed to assist in the alignment of the top surfaces 44*a* and 44*b*. It will be readily appreciated that substantially any suitable device and method for aligning the printable top surfaces 44*a* and 44*b* so as to be co-planar and provide a substantially planar printing surface is within the scope of the present invention.

Figure 8:
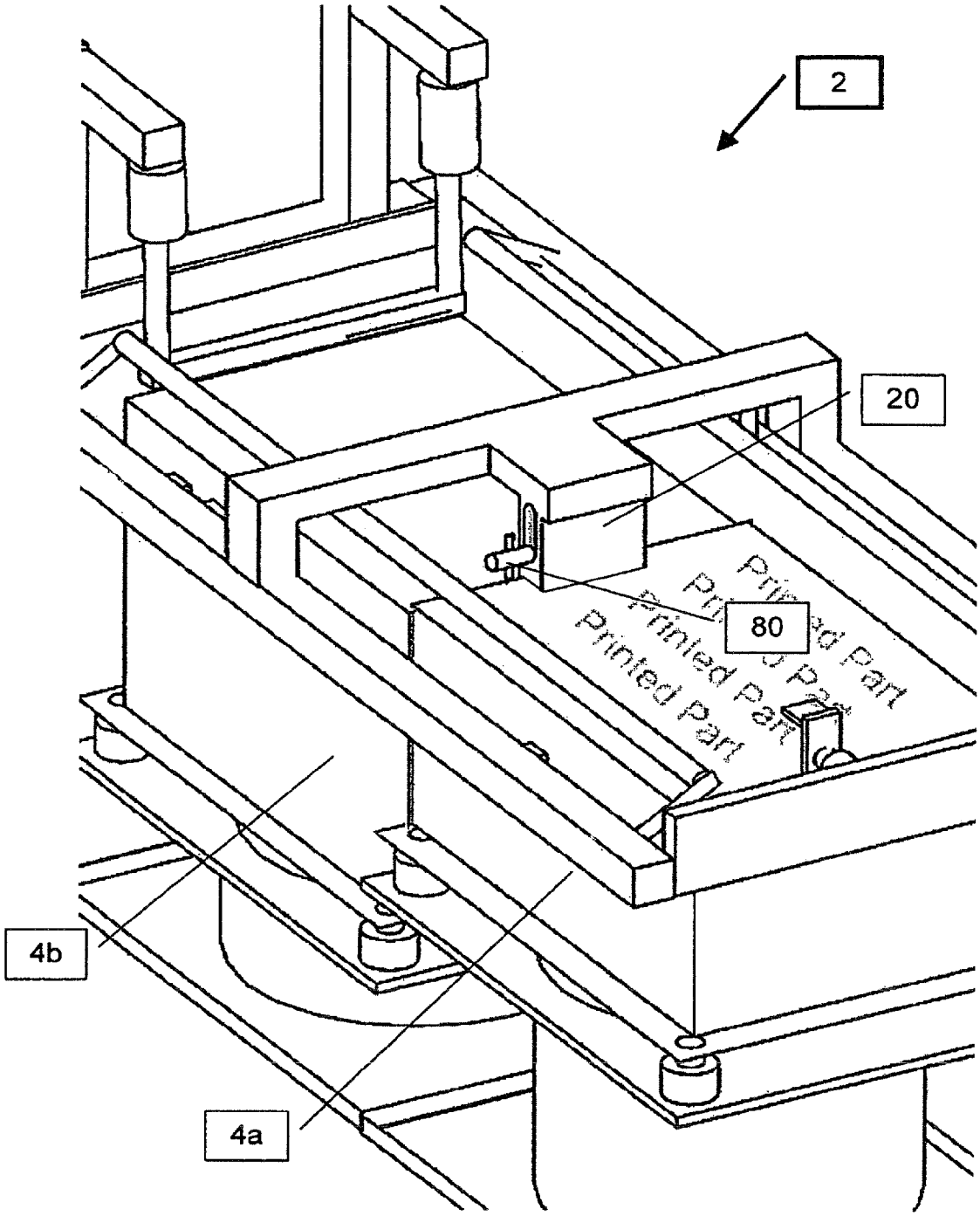
FIG. 8 is an isometric view of a preferred embodiment of a cutting element constructed and operative according to the teachings of the present invention, illustrated on the embodiment of FIG. 2.

As illustrated in FIG. 8, upon completion of the printing process, the stack 4*a* of now printed pages are separated from the unprinted pages in stack 4*b*. Preferably, separation of the two stacks 4*a* and 4*b* is accomplished with a cutting element 80, which is shown here associated with the printing device 20. It should be noted that the cutting element need not be associated with the printing device, and may be done manually. Therefore, substantially any method of separating the two stacks 4*a* and 4*b* is within the scope of the present invention.

Figure 9:
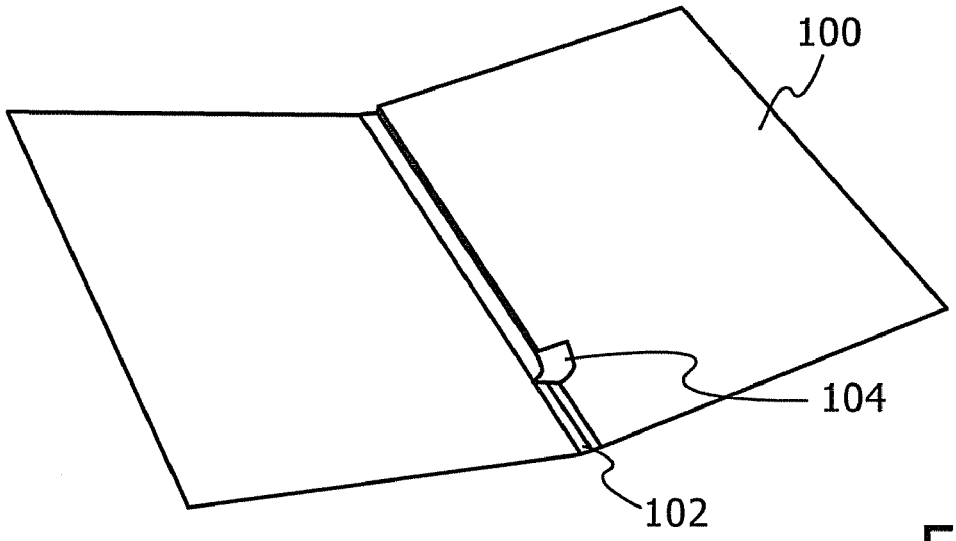
FIG. 9 is an isometric view of a book-cover constructed and operative according to the teachings of the present invention.
Figure 10:
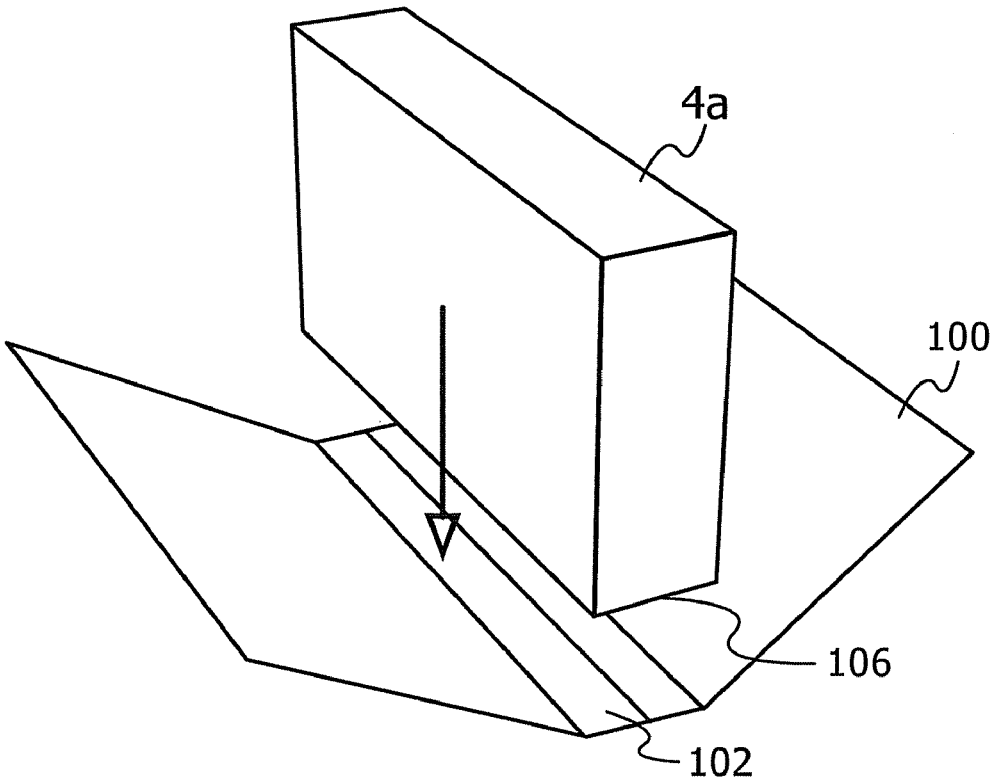
FIGS. 10-12 are isometric views of the process of attaching the printed pages of the book to the book-cover of FIG. 9.
Figure 11:
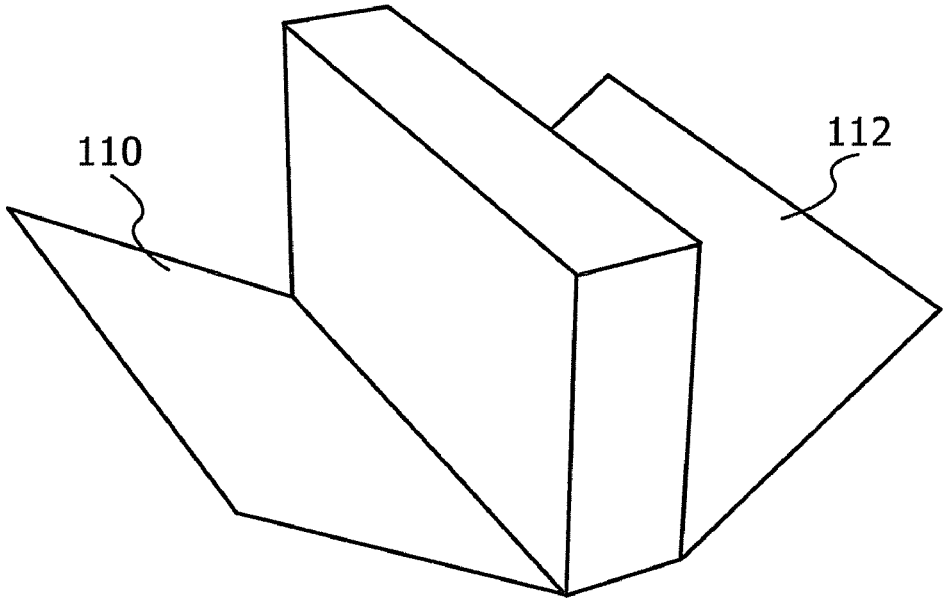
Figure 12:
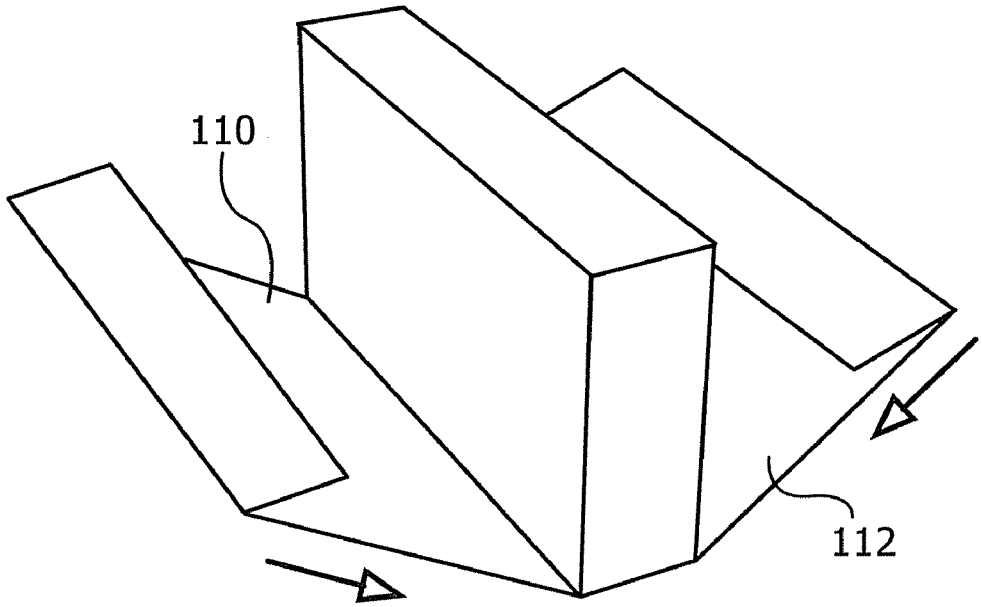

To complete the book, a book-cover 100 is attached to the stack 4*a* of now printed pages once the stack 4*a* is removed from the printing apparatus 2. The process of attaching the book-cover 100 is illustrated in FIGS. 9-12. The pre-fabricated adjustable book-cover 100 of the present invention includes an adhesive spine area 102 shielded by at least one peel-off cover-section 104 configured to reveal a predetermined adhesive area when removed. As illustrated in FIG. 9, in order to attach the stack 4*a*, the peel-off cover-section 104 is removed to reveal an area of the adhesive spine 102 corresponding to the size of a binding area 106 of stack 4*a*. The stack 4*a* is then pressed onto the revealed adhesive spine 102 (FIGS. 10 and 11).

Since the width of the binding area 106 will vary for one book to another, the front 110 and back 112 cover portions of the book-cover are preferably over-sized. Therefore, the front 110 and back 112 cover portions may need to be adjusted to the size of the stack 4*a* inserted into the book-cover. This may be accomplished by simply folding the front 110 and back 112 cover portions over to size. Alternatively, or additionally, the extreme edges of the front 110 and back 112 cover portions may each be configured with an adhesive portion (not shown) shielded by a peel-off cover-section configured to reveal an adhesive area when removed. It should be noted that substantially any method for attaching a book-cover to the pre-bound pages is within the scope of the present invention.

Therefore, the steps for producing a book according to the teachings of the present invention are as follows:

1. Insert a block 4 of printable pages into the printing apparatus 2, such that the block 4 is arranged in two stacks 4*a* and 4*b*.
2. Print the book on successive top surfaces 44*a* and 44*b* of the two stacks 4*a* and 4*b*.
3. Separate the printed pages of the book from the unprinted pages of the block 4 and remove the printed pages from the printing apparatus 2.
4. Prepare a book-cover 100 by peeling off at least one peel-off cover-section 104 to reveal an area of adhesive spine area 102 corresponding to the area of the binding 106 of the printed pages.
5. Attach the binding 106 of the printed pages to the spine 102 of the book-cover 100.
6. Adjust the extreme edges of the front 110 and back 112 cover portions as needed to fit the printed pages.

It should be noted that additionally the printing apparatus 2 of the present invention may be configured to check that the block 4 includes the number of pages required for the current printing job before printing begins. This may be accomplished by substantially any method known in the art such as, but not limited to, optical sensors, IR detectors, mechanical measuring mechanisms, and other electronic measures. Alternatively, or additionally, the block 4 itself may include an assignment of the number of pages such as but not limited to, numerals, patterns, and other graphic representations, printed on one or more of the sides of the block 4.

It will be appreciated that the above descriptions are intended only to serve as examples and that many other embodiments are possible within the spirit and the scope of the present invention.

What is claimed is:

1. A method for producing printed material, the method comprising:

(a) providing a block configured from a plurality of blank pages that are pre-bound by a binding along a binding-edge of each page;

(b) providing a first block support table and a second block support table, a height of the first block support table relative to the second block support table being adjustable;

(c) arranging said block so as to form two adjacent stacks interconnected by said binding, such that at least one of a plurality of the printable pages is deployed in a first stack on the first block support table and a remainder of said plurality of the printable pages is deployed in a second stack on the second block support table, and printable top surfaces of said first stack and said second stack are co-planar;

(d) generating relative movement between a printing device and said printable top surfaces so as to print on said top surface of at least one of said first stack and said second stack;

(e) redeploying a top page of said second stack to said first stack so as to produce new said printable top surfaces;

(f) adjusting a height of each of said first stack relative to said second stack subsequent to each said redeploying said top page of said second stack to said first stack so as to so as to maintain co-planar printable top surfaces of said first stack and said second stack, using at least one sensor to align the top surfaces of the stacks; and (g) repeating steps (d) through (f) as required to print a number of pages required.

2. The method of claim 1, further including separating printed pages of the printed material from said block.

3. The method of claim 2, wherein said separating printed pages is accomplished using a cutting element associated with said printing device, said cutting element configured to separate said first stack from said second stack.

4. The method of claim 1, further including attaching said printed pages of the printed material to a book-cover.

5. The method of claim 4, wherein said book-cover is implemented as a pre-fabricated adjustable book-cover with an adhesive spine area shielded by at least one peel-off cover section configured to reveal a predetermined adhesive area when removed, such that an area of said adhesive spine corresponding to a size of a binding area of said printed pages of the printed material is revealed for said attaching.

6. The method of claim 1, further including determining the number of pages redeployed during said redeploying said top page of said second stack to said first stack using a sensor configured to determine the thickness of material redeployed.

* * * * *